US011337499B2

(12) United States Patent
Lavi

(10) Patent No.: US 11,337,499 B2
(45) Date of Patent: May 24, 2022

(54) HANDBAG WITH DETACHABLE AND INTERCHANGEABLE FACETS

(71) Applicant: Batia Lavi, Brooklyn, NY (US)

(72) Inventor: Batia Lavi, Brooklyn, NY (US)

( * ) Notice: Subject to any disclaimer, the term of this patent is extended or adjusted under 35 U.S.C. 154(b) by 305 days.

(21) Appl. No.: 16/579,283

(22) Filed: Sep. 23, 2019

(65) Prior Publication Data

US 2021/0085043 A1 Mar. 25, 2021

(51) Int. Cl.

| | |
|---|---|
| ***A45C 3/06*** | (2006.01) |
| ***A45C 7/00*** | (2006.01) |
| ***A45C 13/10*** | (2006.01) |
| *A45C 13/22* | (2006.01) |

(52) U.S. Cl.

CPC ..... *A45C 3/06* (2013.01); *A45C 7/009* (2013.01); *A45C 13/103* (2013.01); *A45C 2013/223* (2013.01)

(58) Field of Classification Search

CPC ..... A45C 3/06; A45C 7/009; A45C 13/103; A45C 2013/223

USPC ..... 150/111, 112, 104; 190/110

See application file for complete search history.

(56) References Cited

U.S. PATENT DOCUMENTS

| | | | | |
|---|---|---|---|---|
| 5,009,319 A * | 4/1991 | Jantzen | ..... | A45C 3/00 150/104 |
| 7,789,114 B2 * | 9/2010 | Pace | ..... | A45C 3/08 150/105 |
| 2005/0173034 A1 * | 8/2005 | Antrobus | ..... | A45C 9/00 150/113 |
| 2006/0207697 A1 * | 9/2006 | Greiner | ..... | A45C 7/0095 150/113 |
| 2009/0288744 A1 * | 11/2009 | Moshirisfahini | ..... | A45C 3/08 150/104 |

FOREIGN PATENT DOCUMENTS

| | | | | |
|---|---|---|---|---|
| WO | WO-9727125 A1 * | 7/1997 | ..... | B25H 3/00 |

* cited by examiner

*Primary Examiner* — Valentin Neacsu
*Assistant Examiner* — Jessica Kavini Tamil
(74) *Attorney, Agent, or Firm* — The Roy Gross Law Firm, LLC; Roy Gross

(57) ABSTRACT

The present invention relates, in some embodiments thereof, to a modular handbag with detachable parts. The handbag includes a bag's body with front and back facets, side facets and a bottom facet. At least one of the bag's body facets is reversibly detachable, allowing a user to exchange one or more of the facets and design the handbag as desired. The handbag may further include a top cover with an opening and one or more straps.

16 Claims, 14 Drawing Sheets

HANDBAG WITH DETACHABLE AND INTERCHANGEABLE FACETS

FIELD OF THE INVENTION

The present invention relates, in some embodiments thereof, to a modular handbag with detachable parts. The handbag includes a bag's body with front and back facets, side facets and a bottom facet. At least one of the bag's body facets is reversibly detachable, allowing a user to replace one or more of the facets and design the handbag as desired. The handbag may further include a top cover with an opening and one or more straps.

BACKGROUND OF THE INVENTION

The majority of western population possesses several handbags, having different styles and colors for use in various occasions and clothing. Nevertheless, for economic or other reasons, a single handbag that can be redesigned to fit numerous occasions and purposes is often desirable.

Commercially available handbags include, for example, exchangeable accessories, inter alia, exchangeable straps, or decorations. Other commercially available handbags include one or more attachable compartments, such as cosmetics cases, wallets and additional compartments, that detach or fit each other. Such commercially available handbags are limited in their redesign properties and typically do not permit color/style/design adaptations.

The current invention pertains to a modular handbag having a handbag body with one or more replaceable facets that can be adapted and designed to fit various occasions/needs and styles.

SUMMARY OF THE INVENTION

The present invention pertains to an inventive modular, handbag with one or more detachable and replaceable portions, allowing to redesign/change color of the handbag, hence adaptation thereof to various occasions and/or clothing.

It is a further object of the present invention to provide a modular handbag having detachable straps possessing various lengths and shapes that can be connected to the handbag so that the handbag can be configured to fulfill various needs.

It is a further object of the present invention to provide a modular handbag with one or more detachable facets that can be readily interchanged, allowing a user to create different looks and styles of the handbag.

In an aspect of the invention, there is provided a modular and changeable handbag, the handbag comprises:

a front facet, a back facet, a first and second side facets, and a bottom facet, the facets, when joined together, form a bag's body, wherein at least one of the facets is reversibly detachable from the bag's body, allowing attachment and detachment and/or replacement thereof with an alternative facet.

In one or more embodiments, the front and back facets of the bag's body are reversibly detachable and interchangeable.

In one or more embodiments, the handbag further comprises side facets integrally connected to a bottom facet forming a unitary sides-bottom facet, the unitary sides-bottom facet is detachable and interchangeable within the handbag.

In one or more embodiments, the side facets of the bag's body are reversibly detachable and interchangeable.

In one or more embodiments, the bottom facet of the bag's body is reversibly detachable and interchangeable.

In one or more embodiments, the front facet, back facet, and first and second side facets, are reversibly detachable and interchangeable.

In one or more embodiments, the front facet, back facet, first and second side facets, and bottom facet are reversibly detachable and interchangeable.

In one or more embodiments, the one or more reversibly detachable facets is connected to adjacent facets via a reversible engagement mechanism.

In one or more embodiments, the reversible engagement mechanism selected from the group consisting of: a zipper, a snap, a button, a hook and lock mechanism, an adhesive, a magnet, a clasp, clips, custom made attachment, custom closure, key, lock, buckle, knot, bow, twist lock, turn lock, tuck lock, and combinations thereof.

In one or more embodiments, the handbag further comprising a top facet for covering a top opening of the bag's body. In one or more embodiments, the top facet includes an opening/closure mechanism for allowing opening and closing the bag's body.

In one or more embodiments, the opening/closure mechanism is selected from a group consisting of a zipper, a snap, a button, a hook and lock mechanism, an adhesive, a magnet, a clasp, clips, custom made attachment, custom closure, key, lock, buckle, knot, bow, twist lock, turn lock, tuck lock, and combinations thereof. In one or more embodiments, the top facet is connected to one or more of the bag's body facets via a reversible engagement mechanism.

In one or more embodiments, the reversible engagement mechanism is selected from the group consisting of: a zipper, a snap, a button, a hook and lock mechanism, an adhesive, a magnet, a clasp, a buckle and combinations thereof.

In one or more embodiments, the top facet is reversibly detachable from one or more facets of the bag's body.

In one or more embodiments, the bottom facet includes foldable side flaps configured to overlap bottom ends of the side facets and attach thereto.

In one or more embodiments, the flaps connected to the bottom ends of the side facets via an engagement mechanism comprising a magnetizing element and a corresponding magnetized element.

In one or more embodiments, the handbag further comprising one or more straps configured to connect the bag's body via straps attachment means disposed on one or more of the facets and corresponding attachment means disposed on the straps' ends.

In one or more embodiments, the straps selected from handle straps, shoulder straps and long cross-body straps.

In one or more embodiments, the straps attachment means selected from a clip, a buckle, a snap, an adhesive, a magnet, a snap hook-ring.

In one or more embodiments, the handbag used for allowing customized redesign of the handbag by replacement of one or more of the facets with one or more alternative facets having a different color, fabric and/or drawing.

Unless otherwise defined, all technical or/and scientific terms used herein have the same meaning as commonly understood by one of ordinary skill in the art to which the invention pertains. Although methods and materials similar or equivalent to those described herein can be used in the practice or testing of embodiments of the invention, exemplary methods or/and materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

Figure 1:
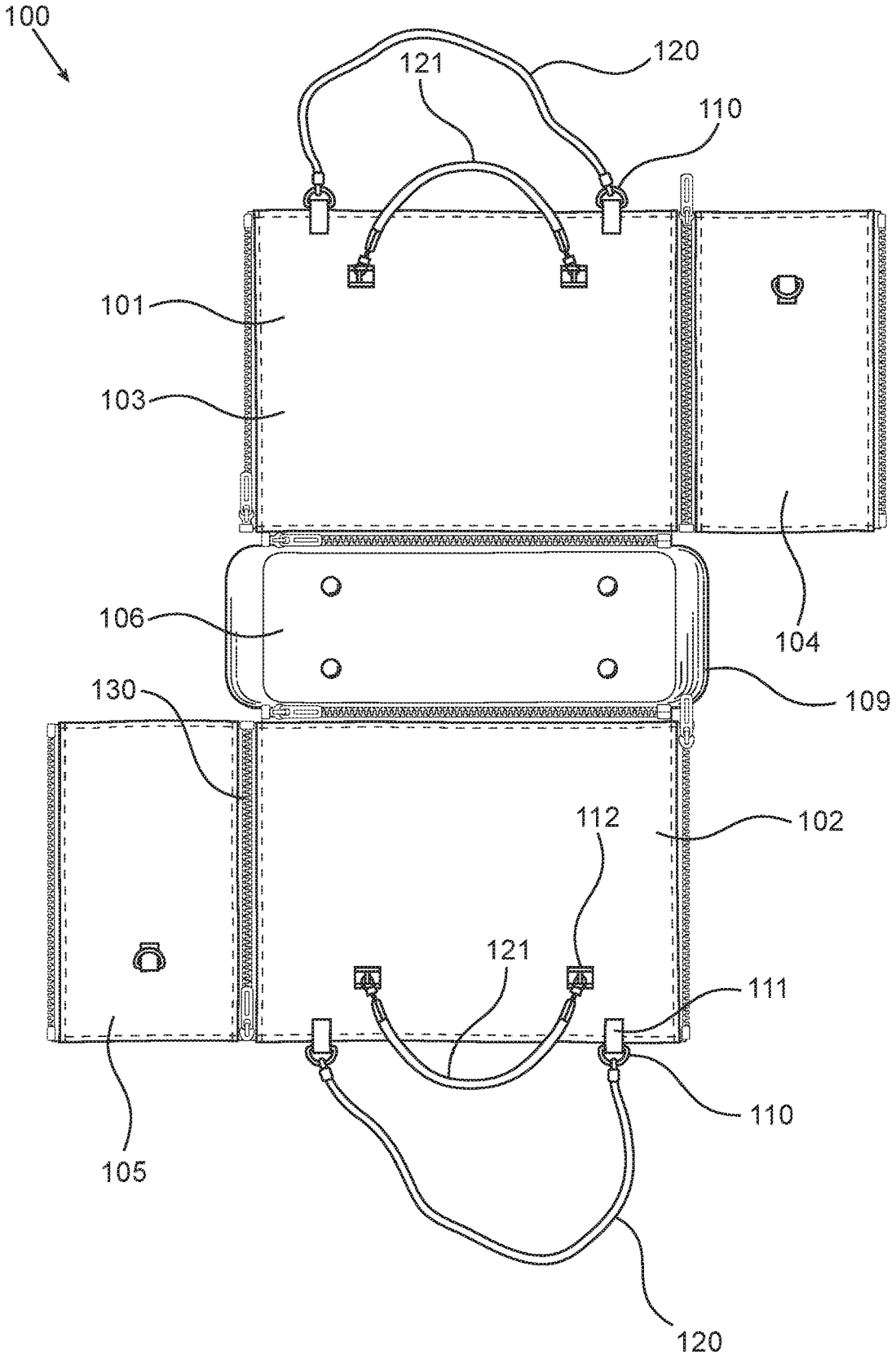
FIG. 1 is a top view presentation showing a flattened external side of an exemplary modular handbag, according to some embodiments of the invention.

It should be appreciated that for simplicity and clarity of illustration, elements shown in the figures have not necessarily been drawn to scale. For example, the dimensions of some of the elements are exaggerated relative to each other for clarity. Further, where considered appropriate, reference numerals have been repeated among the figures to indicate corresponding elements.

DETAILED DESCRIPTION OF THE INVENTION

It is understood that the invention is not limited to the particular methodology, devices, items or products etc., described herein, as these may vary as the skilled artisan will recognize. It is also to be understood that the terminology used herein is used for the purpose of describing particular embodiments only, and is not intended to limit the scope of the invention. The following exemplary embodiments may be described in the context of exemplary handbags for ease of description and understanding. However, the invention is not limited to the specifically described products and methods, and may be adapted to various applications without departing from the overall scope of the invention. All ranges disclosed herein include the endpoints. The use of the term "or" shall be construed to mean "and/or" unless the specific context indicates otherwise.

The present invention pertains to a handbag with a bag body having one or more detachable parts that can be interchanged with compatible alternative parts and thereby allow the user to adjust/design/personalize the style and/or color of the handbag.

Fashion bags are typically sold as a single piece. In many cases, the straps and handles can be removed and changed, but the main compartment of the bag is provided as a single portion. The present invention pertains to a handbag wherein the bag's body can be designed by the user/wearer in color/style, allowing adaptation of the handbag to various occasions and clothing.

The herein disclosed handbag having a handbag body with one or more detachable parts. The one or more detachable parts can be replaced with alternative parts. The alternative parts may have a different style or color, allowing the user/wearer to design the bag as desired.

The bag's body include the following parts/facets:

a front facet;
a back facet,
a bottom facet,
a first side facet; and
a second side facet.

In one or more embodiments, one or more of the herein disclosed facets is detachable. In one or more embodiments, two or more of the herein disclosed facets is detachable. In one or more embodiments, three or more of the herein disclosed facets is detachable. In one or more embodiments, four or more of the herein disclosed facets is detachable. In one or more embodiments, all herein disclosed handbag facets are detachable.

In one or more embodiments, the front facet is detachable. In one or more embodiments, the back facet is detachable. In one or more embodiments, the front and back facets are detachable.

In one or more embodiments, the first side facet is detachable. In one or more embodiments, the second side facet is detachable. In one or more embodiments, the first and second side facets are detachable.

In one or more embodiments, the bottom facet is detachable.

In one or more embodiments, the one or more of the herein disclosed detachable facets is interchangeable with an alternative facet.

The alternative facet may be similar or even identical in size and/or shape to the facet it replaces. The alternative facet may be manufactured from a different material or fabric. The alternative facet may have a different style, contour, design, illustration and/or color, allowing the wearer to update/change the style/color/appearance of the bag. Optionally, the alternative facet is similar also in color and/or illustration to the original facet, allowing the wearer to replace specific outworn/dirty facets of the bag.

The one or more facets are connected to each other, thereby forming the bag's body. The one or more facets are reversibly connected to each other via an engagement mechanism, allowing the facets to connect and disconnect each other. Various reversible engagement mechanisms are contemplated. Non limiting examples include, a zipper, a hook and lock mechanism, an adhesive, a snap, a button, a magnet, and combinations thereof.

The one or more facets may conveniently include one or more internal pockets for storing belongings.

As described herein the handbag includes a main bag body comprising a front facet and a back facet. Optionally, one of the front and back facets are detachable. Optionally, both the front and back facets are detachable. Optionally, the front and back facets are similar, optionally identical in size and/or shape.

A user may change one or both the front and back facets and update the bag, using alternative facets of different styles and/or colors.

The front and/or back facets may include attachment means such as a buckle, and a grommet that allows to attach thereto one or more of the bag's straps.

In one or more embodiments, the bottom facet of the bag is detachable and connectable to one or more facets via an engagement mechanism. In one or more embodiments, the bottom facet of the bag is non-detachable and integrally manufactured with or connected to one or more of the bag facets via one or more seams. Optionally, a zipper extends along one or more ends of the bottom facet. Optionally, a zipper extends along longitudinal ends of the bottom facet. Optionally, a zipper extends along one or both width ends of the bottom facet. The bottom facet may, for example, include flaps that can be folded and overlap the lower ends of one or both side facets and/or one or both front and back facets and attach thereto via an engagement mechanism, for example via magnetizing forces. In an exemplary embodiment, the bottom facet includes a zipper at opposing longitudinal sides. In yet a further exemplary embodiment, the side ends of the bottom facet include flaps with an engagement mechanism in the form of a magnet that can connect lower ends of the side facets of the bag.

In one or more embodiments, the bag includes a first and a second side facets and optionally one or both side facets are detachable. The detachable facets connected to one or more other facets via an engagement mechanism. Optionally, a zipper extends along one or more ends of the side facets. Optionally, a zipper extends along longitudinal ends of the side facets. Optionally, a zipper extends along one or both width ends of the side facets. In one or more embodiments, a bottom width end of a first and/or second side facets does not include a zipper. In one or more embodiments, a bottom width end of a first and/or second side facets includes an engagement mechanism in the form of a magnet that allows an attachment to the flaps of the bottom facet. Optionally, the first and second side facets are similar, optionally identical in size and/or shape.

In one or more embodiments, the side facets integrally connected to a bottom facet forming a unitary/singular sides-bottom facet, the unitary sides-bottom facet is detachable and interchangeable within the handbag.

In one or more embodiments, the bag optionally includes a top facet configured to cover a bag's opening and optionally includes a bag's opening and closing mechanism. The top facet may be detachable, optionally, interchangeable with an alternative top portion having a different style/color/contour. The top facet may include flaps or strings.

The top facet may include an engagement mechanism allowing attachment thereof to the front facet, the back facet, the first side facet and/or the second side facet. The top facet includes for example one or more snaps configured to attach one or both the front and back facets. The top facet may be foldable and/or flexible such that one or more ends or flaps thereof is foldable and can overlap and attach one or more top ends of the front facet, the back facet, the first side facet and/or the second side facet.

The top facet may include a closure/opening mechanism allowing closing and opening the handbag. Various closure/opening mechanisms are contemplated such as a zipper, snaps, an adhesive, a magnet, and any pf the alike. In an exemplary embodiment, the top facet includes a closure/opening mechanism in the form of a zipper extending along a length, optionally the midline of the top facet and an engagement mechanism in the form of snaps configured to connect both longitudinal ends of the top facet to the top ends of the front and/or back facets. In an exemplary embodiment, the top facet includes a closure/opening mechanism in the form of a push clasp and an engagement mechanism in the form of zipper configured to connect a longitudinal end of the top facet to the top end of the front or back facet. The herein disclosed handbag may optionally further include one or more straps of various lengths and designs. The various straps may connect the front, the back, the first side and/or the second side facets via an attachment means connected at one or both ends of the straps. The attachment means may be of various forms including, but not limited to a clip, a buckle, a snap, an adhesive, a magnet, a snap hook-ring, and any of the alike. The various straps may present various lengths for allowing various purposes and uses.

The straps may present a length of between about 8 cm and up to about 50 cm. For example, a handle strap may have a length of about 10 cm. For example, between about 8 cm and about 14 cm. A shoulder strap may have a length of about 14 cm. For example, between about 14 cm and about 20. A longer cross-body strap may present a length of up to about 50 cm. The various straps with attachment means can connect complementary attachment means disposed on one more facets of the bag. For example, a female snap may connect a male snap, a hook or clip may connect a ring, etc.

For example, a short handle can be attached, for example, to the rings or bridges disposed on the front and back facets. A longer shoulder straps can attach to attachment means disposed on top of the front and back facets. Long cross-body straps can attach attachment means disposed in the side facets.

The herein disclosed handbag may be manufactured from various materials. Non limiting examples of materials suitable for manufacturing the herein disclosed handbag include, leather, canvas, suede etc.

In yet another exemplary embodiment, the top facet includes small side openings allowing insertion of attachment means through the openings.

As illustrated and described herein above, the instant invention provides a handbag with one or more detachable parts. Such handbag design and configuration advantageously allow bag owners to personalize their bag as desired and according to their needs.

Figure 2:
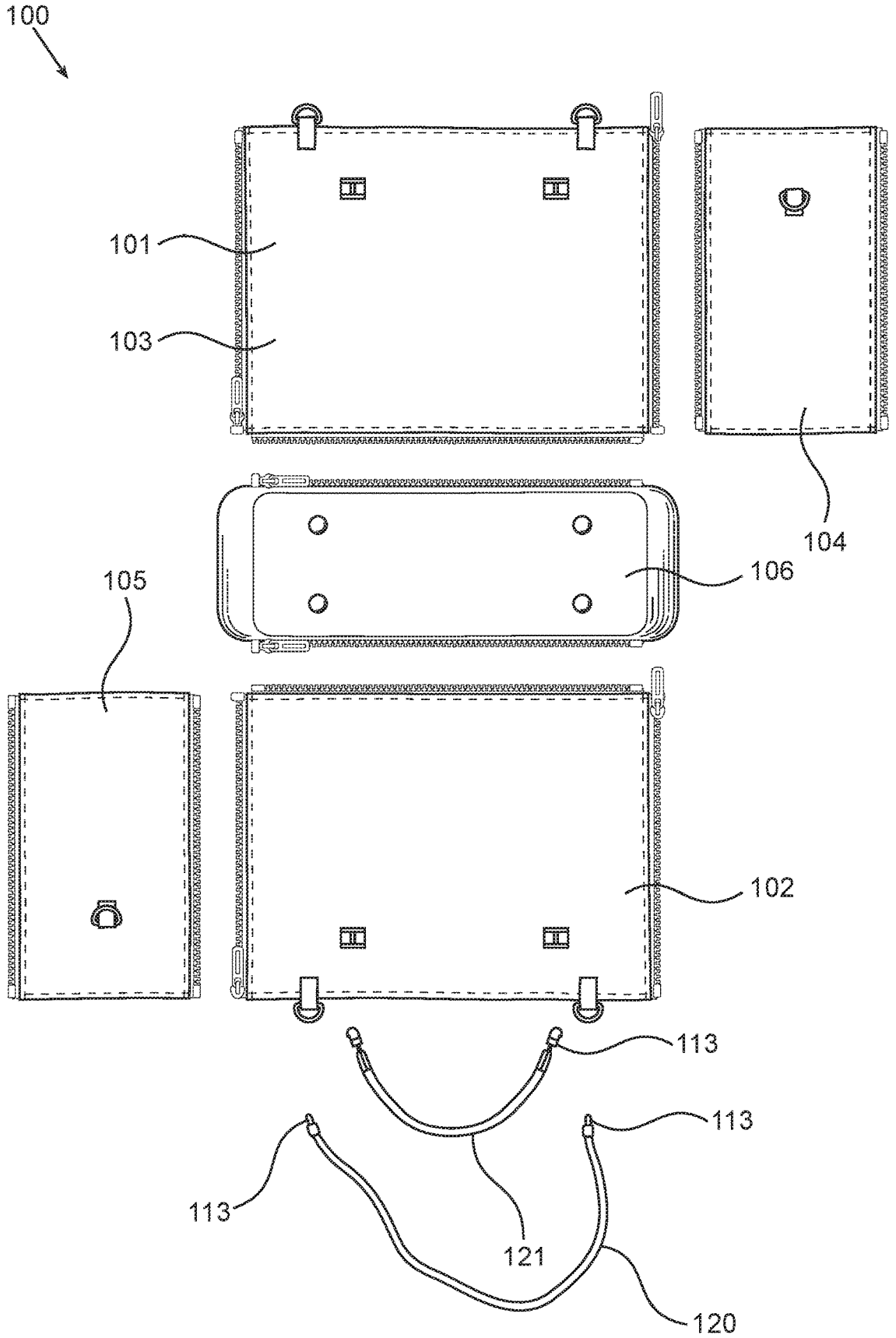
FIG. 2 is an exploded top view presentation showing the external sides of the various facets of an exemplary handbag, according to some embodiments of the invention.
Figure 3:
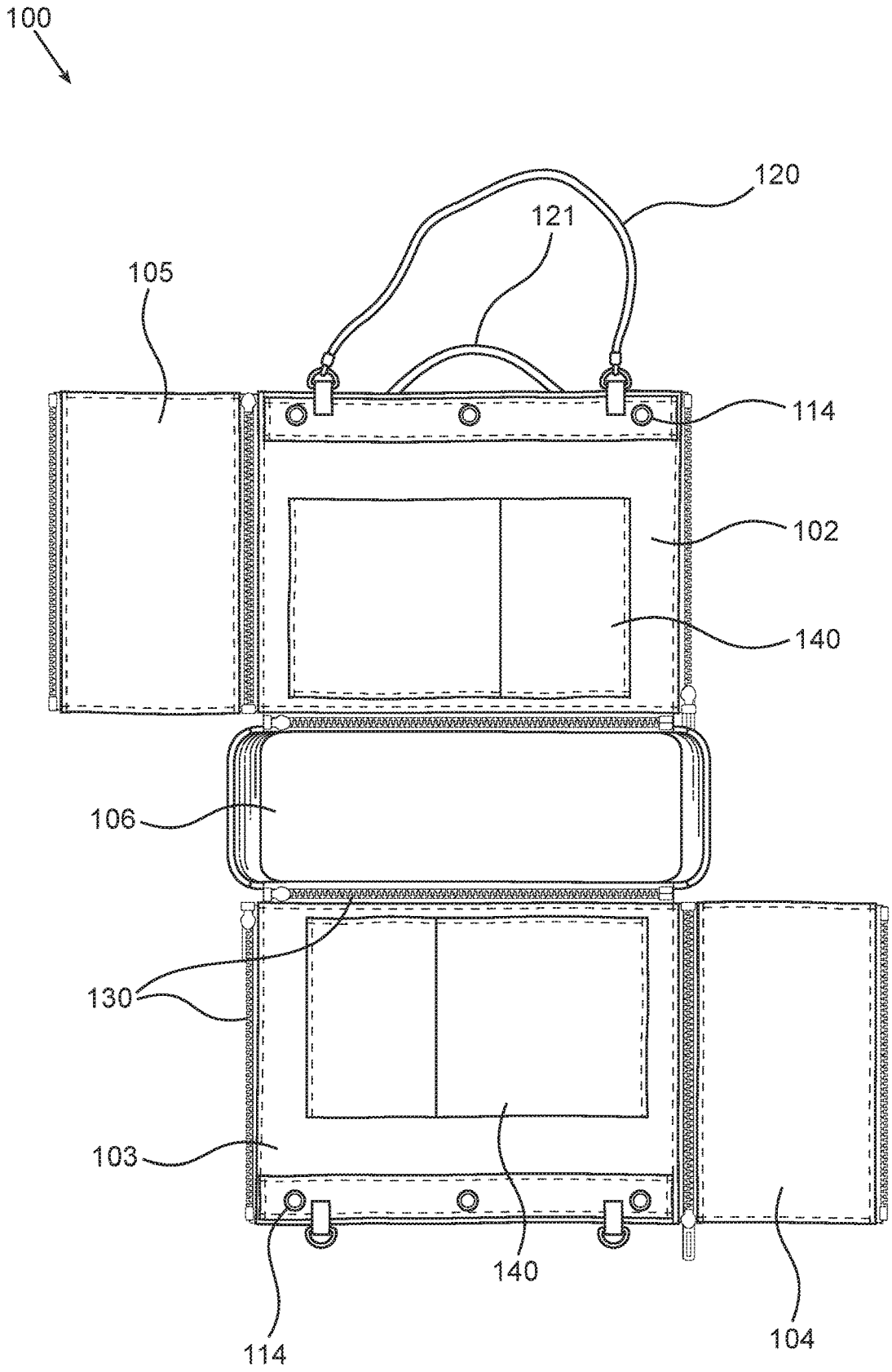
FIG. 3 is a top view presentation showing a flattened internal side of an exemplary modular handbag, according to some embodiments of the invention.
Figure 4:
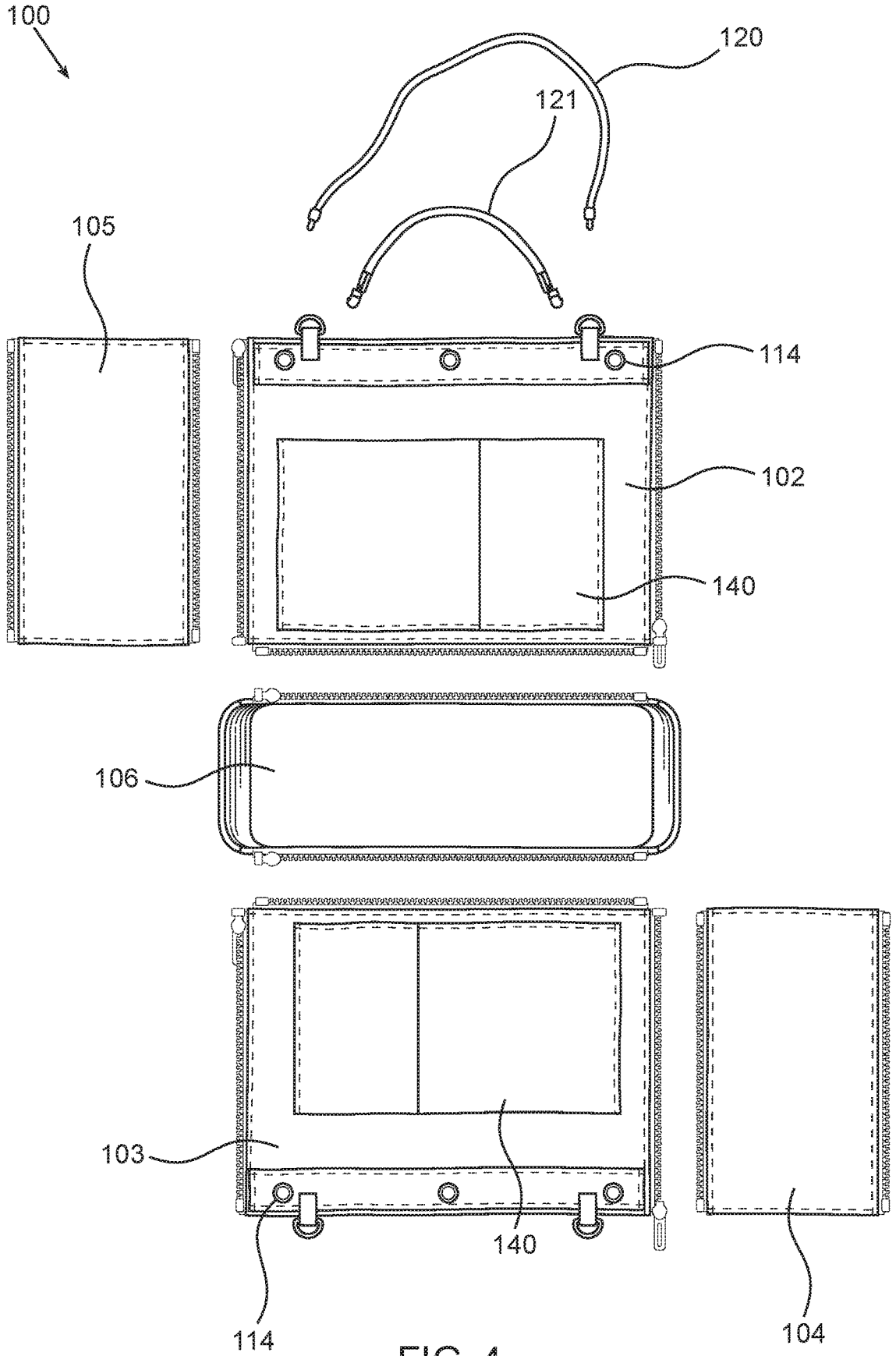
FIG. 4 is an exploded top view presentation showing the internal sides of the various facets of an exemplary handbag, according to some embodiments of the invention.

Referring now to the drawings, FIGS. 1 and 2 are top external views and FIGS. 3 and 4 are top internal views of an exemplary handbag 100 according to some embodiments of the invention. Handbag 100 includes a bag body 101 with detachable/replaceable parts/facets. The bag body 101 includes a front facet 102 and a back facet 103. The bag body 101 further includes a first side facet 104 and a second side facet 105. The bag body further includes a bottom facet 106 which can communicate with all facets, namely, with front facet 102, back facet 103, a first side facet 104 and a second side facet 105. When joined together, the bag's facets 102, 103, 104, 105 and 106 form bag body 101 of handbag 100.

Front facet 102 and back facet 103 may be essentially similar in size and/or shape. Front facet 102 and back facet 103 may be identical in size and/or shape. Nevertheless, front facet 102 and back facet 103 may be different in size and/or shape as long as they can associate with other bag facets to thereby form bag body 101.

First side facet 104 and second side facet 105 may be essentially similar in size and/or shape. First side facet 104 and second side facet 105 may be identical in size and/or shape. Nevertheless, first side facet 104 and second side facet 105 may be different in size and/or shape as long as they can associate with other bag facets to thereby form bag body 101.

An engagement mechanism in the form of zippers 130 may be used to allow the attachment of the bag facets to thereby form bag body 101. Nevertheless, alternative engagement mechanisms are contemplated and may be applicable. Non limiting engagement mechanisms include, a hook and lock mechanism, an adhesive, snaps, buttons, magnets, and combinations thereof.

Optionally, one or more internal pockets 140 for storing belongings may be sewed internally in one or both front facet 102 and back facet 103 (FIGS. 2-3).

The handbag 100 may further include one or more straps. For example, a handle strap 121 as well as a shoulder strap 120 are incorporated to bag body 101. In this particular embodiment, straps 121 attached to front facet 102 and back facet 103 via dedicated rings 112 incorporated onto front facet 102 and back facet 103 and clips 113 that can connect the rings 112. Shoulder straps 120 attached to front facet 102 and back facet 103 via dedicated rings 110 attached to the top ends of front facet 102 and back facet 103 and clips 113. Other embodiments can be applicable and have the straps 120 and 121, attach to bag body 101 via other attachment means, such as fasteners, by sewing, via hooks, snaps, hook and lock mechanisms or other manners. An exemplary embodiment of handbag 100 includes rings 110 connected to the top ends of front facet 102 and back facet 103 via sewed loops 111. Along cross body strap 123 may be optionally further incorporated to handbag 100 (shown in 7).

Figure 9:
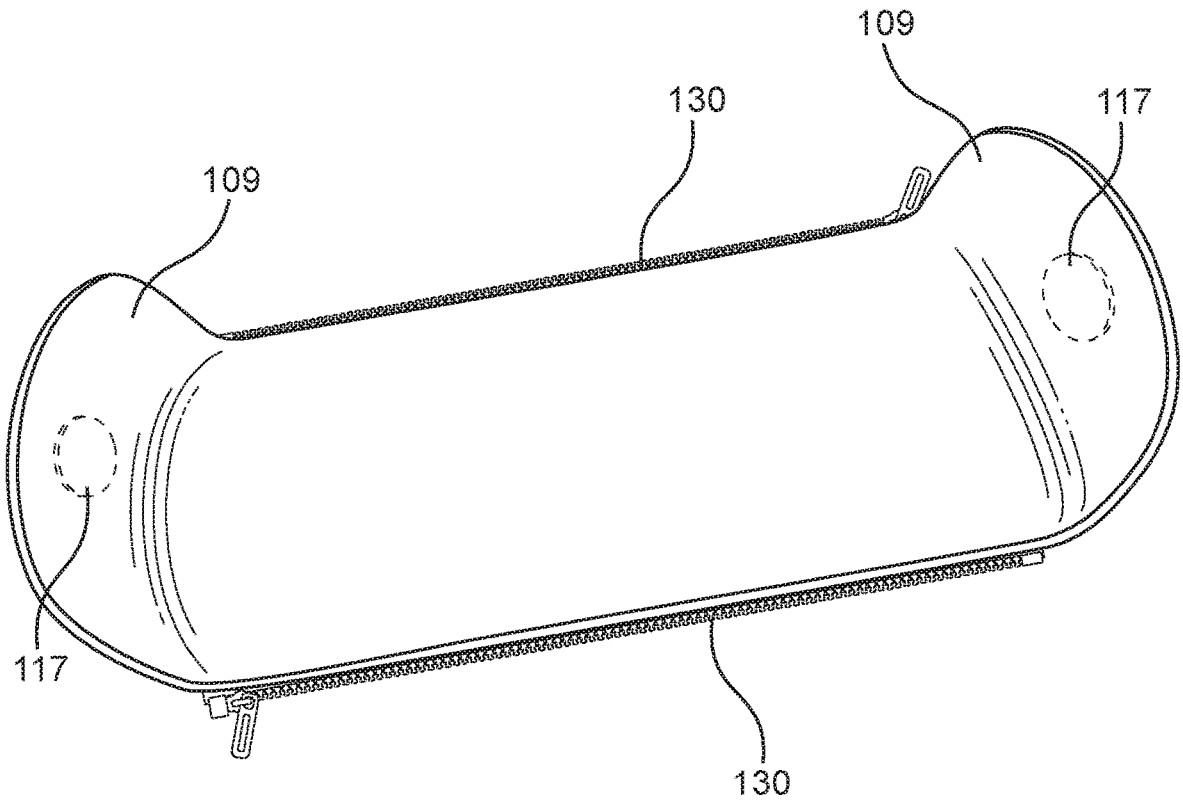
FIG. 9 is a perspective front view presentation showing a bottom facet of a handbag, according to some embodiments of the invention.

Bottom facet 106 (shown individually in FIG. 9) may include two engagement mechanisms in the form of zippers 130 disposed on the longitudinal ends of the bottom facet 106 and configured to allow for an engagement with front and back facets 102 and 103, respectively. Optionally, and as illustrated herein, side flaps 109 which are foldable upwardly are configured to attach bottom ends of side facets 104 and 105 via a magnetizing element 117 sewed within side flaps 109 and a corresponding magnetized element sewed within the bottom ends of side facets 104 and 105 (not shown). In an alternative applicable embodiment, a magnetizing element 117 is sewed within bottom ends of side facets 104 and 105 and a corresponding magnetized element sewed within the side flaps 109.

Flaps 109 may be folded to overlap at least partially bottom ends of the side facets 104 and 105 from externally. Alternatively, flaps 109 may be folded to overlap at least partially bottom ends of the side facets 104 and 105 from internally.

As illustrated herein, the engagement between the one or more facets of handbag 100 includes connecting the facets 102, 103, 104 and 105 via the engagement mechanisms, here zippers 130 and folding internally flaps 109 and connecting them to side facets 104 and 105 via magnets. Alternative engagement mechanisms are contemplated as described herein.

Figure 5:
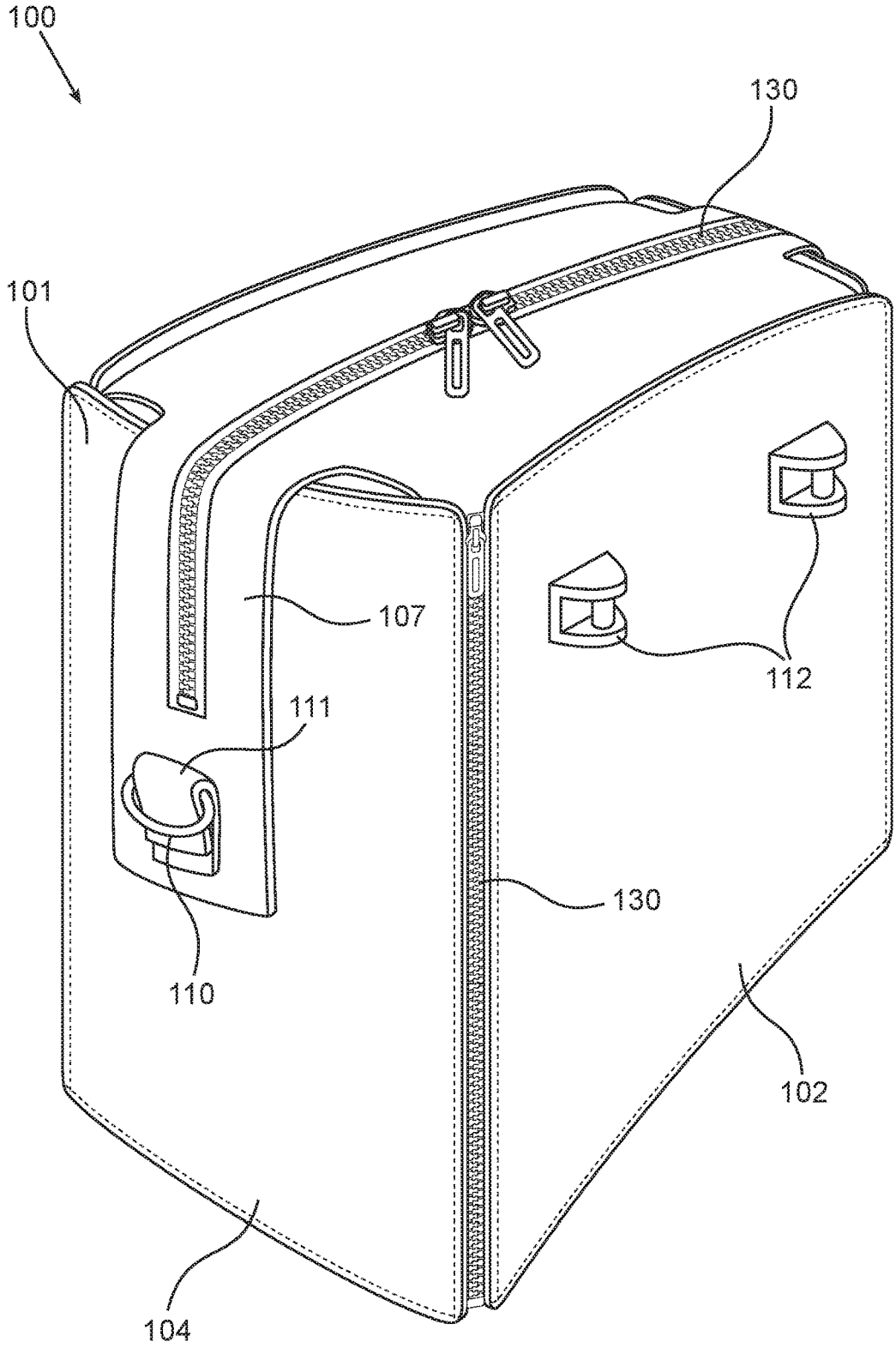
FIG. 5 is a side perspective view presentation showing an exemplary handbag, according to some embodiments of the invention.
Figure 6:
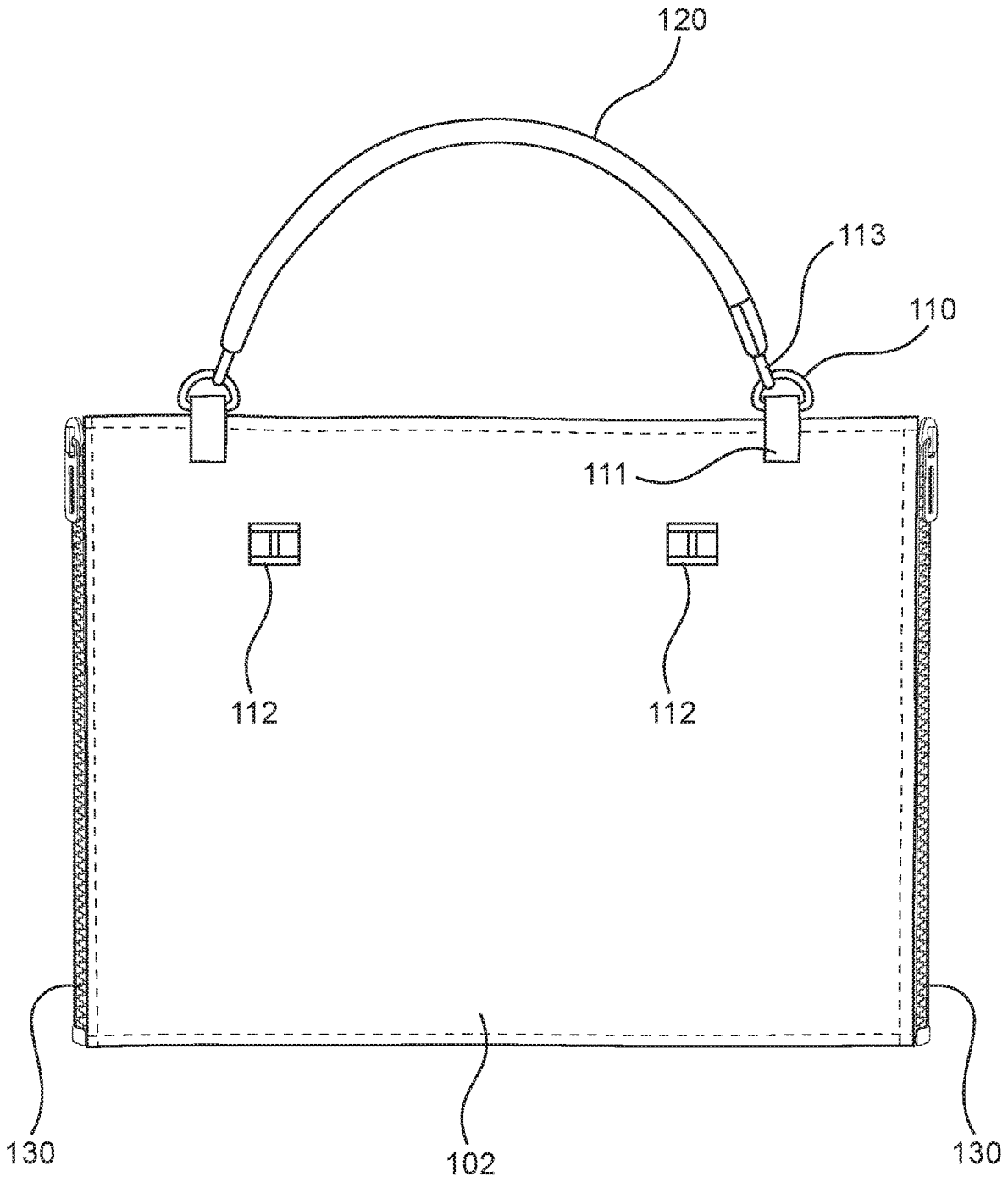
FIG. 6 is a front view presentation showing the front facet of an exemplary handbag, according to some embodiments of the invention.
Figure 7:
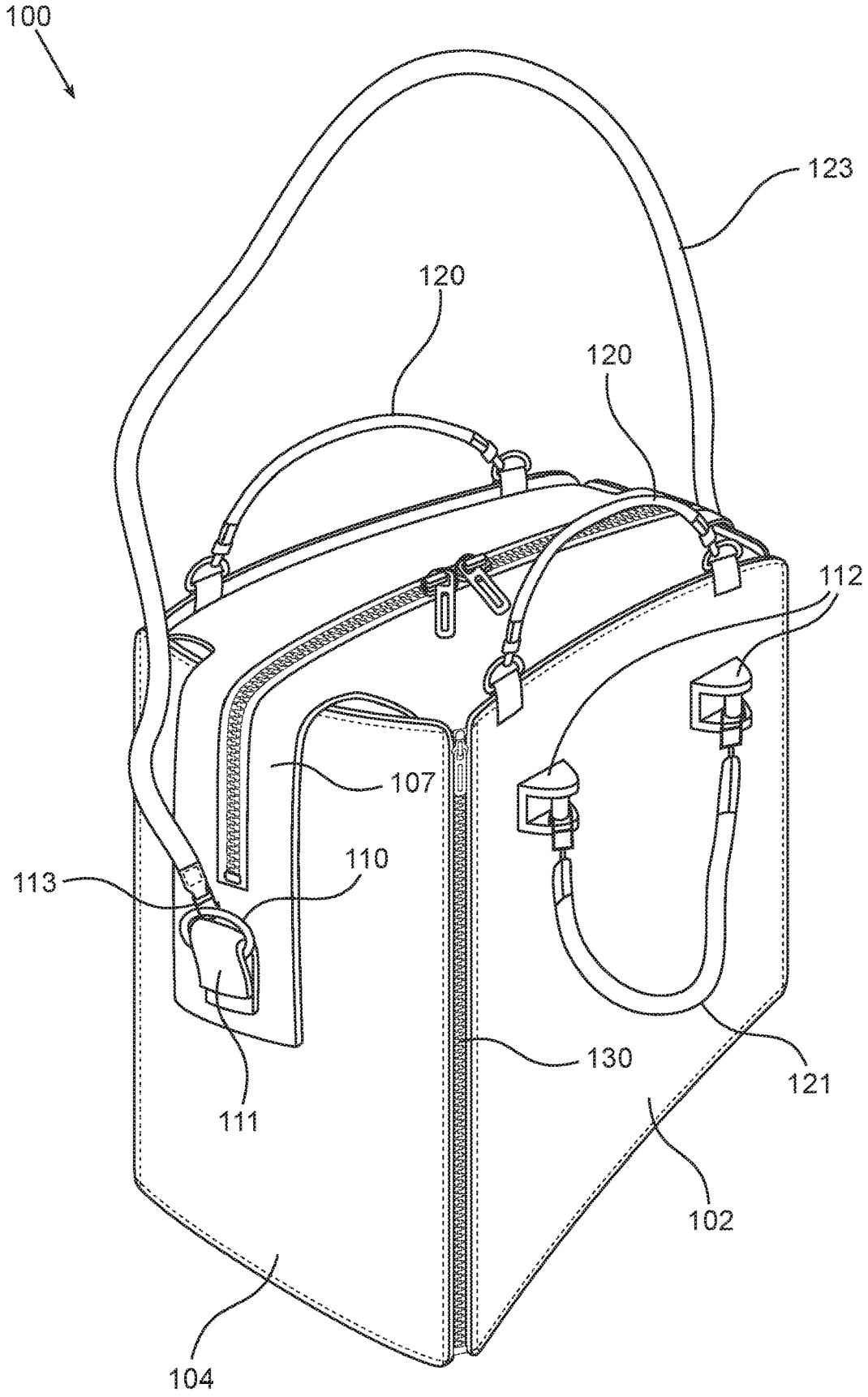
FIG. 7 is a side perspective view presentation showing an exemplary handbag with various strap types attached thereto, according to some embodiments of the invention.
Figure 8:
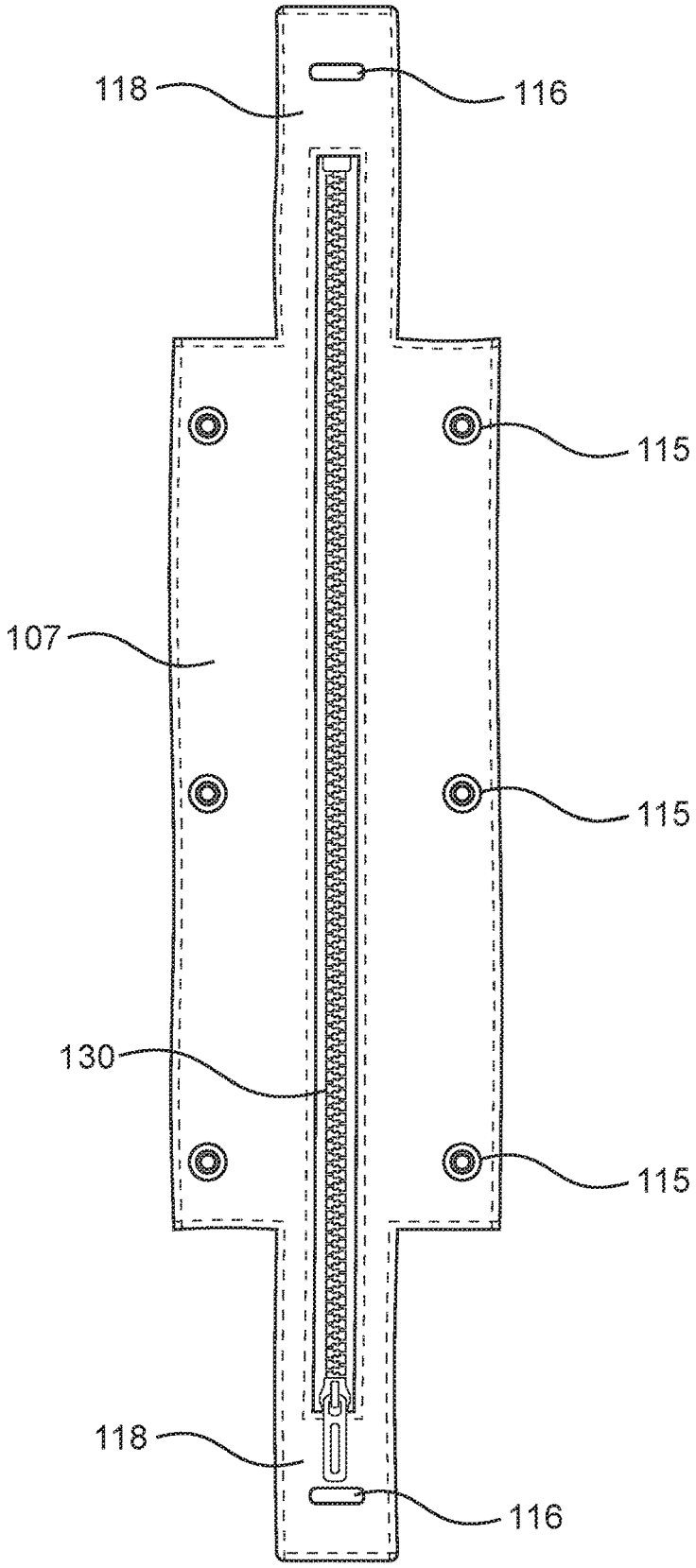
FIG. 8 is a top view presentation showing a top facet of a handbag, according to some embodiments of the invention.

As illustrated in FIGS. 5 and 7, and 8, handbag 100 may further include a top facet 107 for covering an opening of bag body 101. Top facet 107 includes a closure mechanism, here zipper 130 for allowing opening and closing the bag. Top facet 107 is herein shown to be detachable and/or replaceable. Nevertheless, top facet 107 may be integrally (monolithically) connected to one or more of front facet 102, back facet 103, first side facet 104 and second side facet 105. An exemplary engagement mechanism in the form of snaps disposed on longitudinal ends of top facet 107 may be used to connect it to front facet 102 and back facet 103.

In an exemplary embodiment and as illustrated in FIG. 8, male snaps 115 disposed on longitudinal ends of top facet 107 can connect internal top ends of front facet 102 and back facet 103 via female snaps 114 (shown in FIGS. 3 and 4). The attachment of top facet 107 to side facets 104 and 105 may be configured via foldable side extensions 118 which fold on top of side facets 104 and 105 (shown in FIGS. 5 and 7). Openings 116 on extensions 118 configured to allow insertion of side loops 111 and rings 110 therethrough such that long cross-body straps 123 may be attached to rings 110 via clips disposed at opposing ends of the strap 123.

Figure 10:
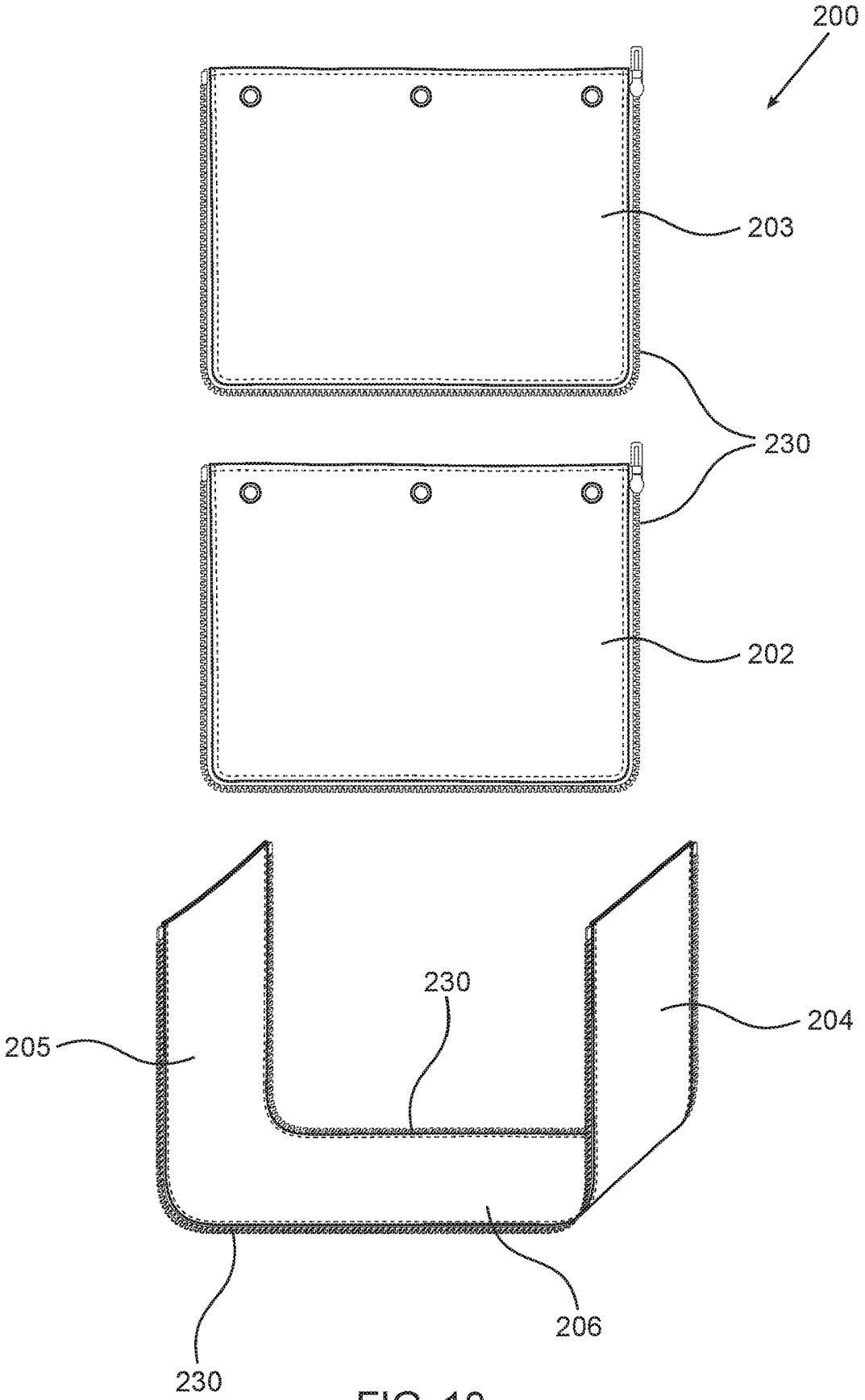
FIG. 10 is an exploded view presentation showing an exemplary handbag with exchangeable front facet, back facet, and a bottom-side facets, according to some embodiments of the invention.
Figure 11:
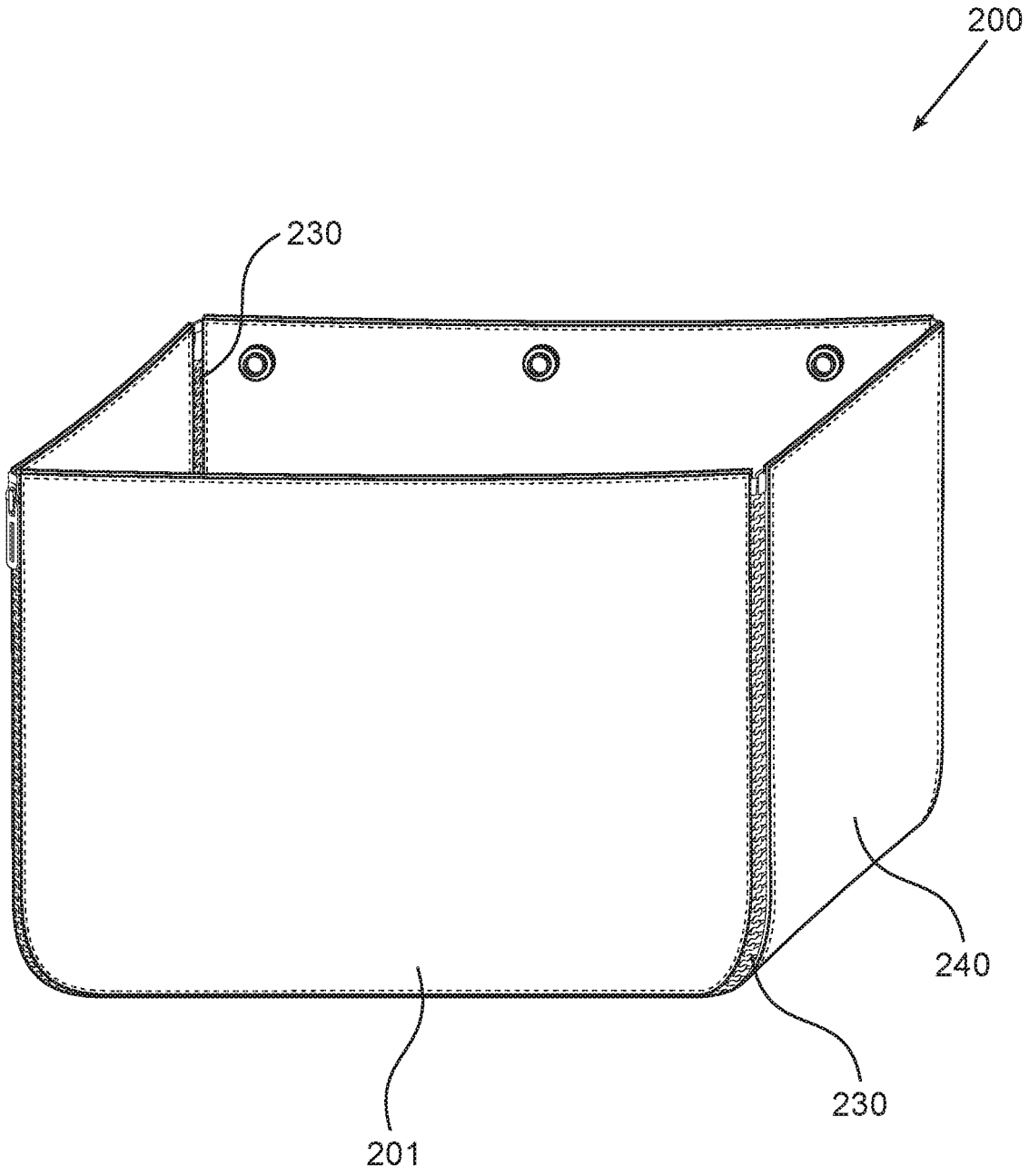
FIG. 11 is a side perspective view presentation showing the exchangeable parts of the handbag of FIG. 10 when joined together, according to some embodiments of the invention.

FIGS. 10 and 11 illustrate yet another exemplary handbag 200 according to some embodiments of the invention. Handbag 200 includes three detachable/replaceable parts, being i) front facet 202 ii) back facet 203, and iii) side facets 204 and 205 which continuously attach bottom facet 206, forming a singular/unitary detachable/replaceable part.

An engagement mechanism in the form of zippers 230 may be used to allow the attachment of the bag's facets to thereby form bag body 201. In handbag 200, zippers 230 continuously extend along the side ends and bottom end of the first and second facets 202 and 203, respectively. Two longitudinal zippers 230 disposed at opposing side ends of unitary bottom-side facets to allow the engagement thereof with the front facet 202 and back facet 203.

Figure 12:
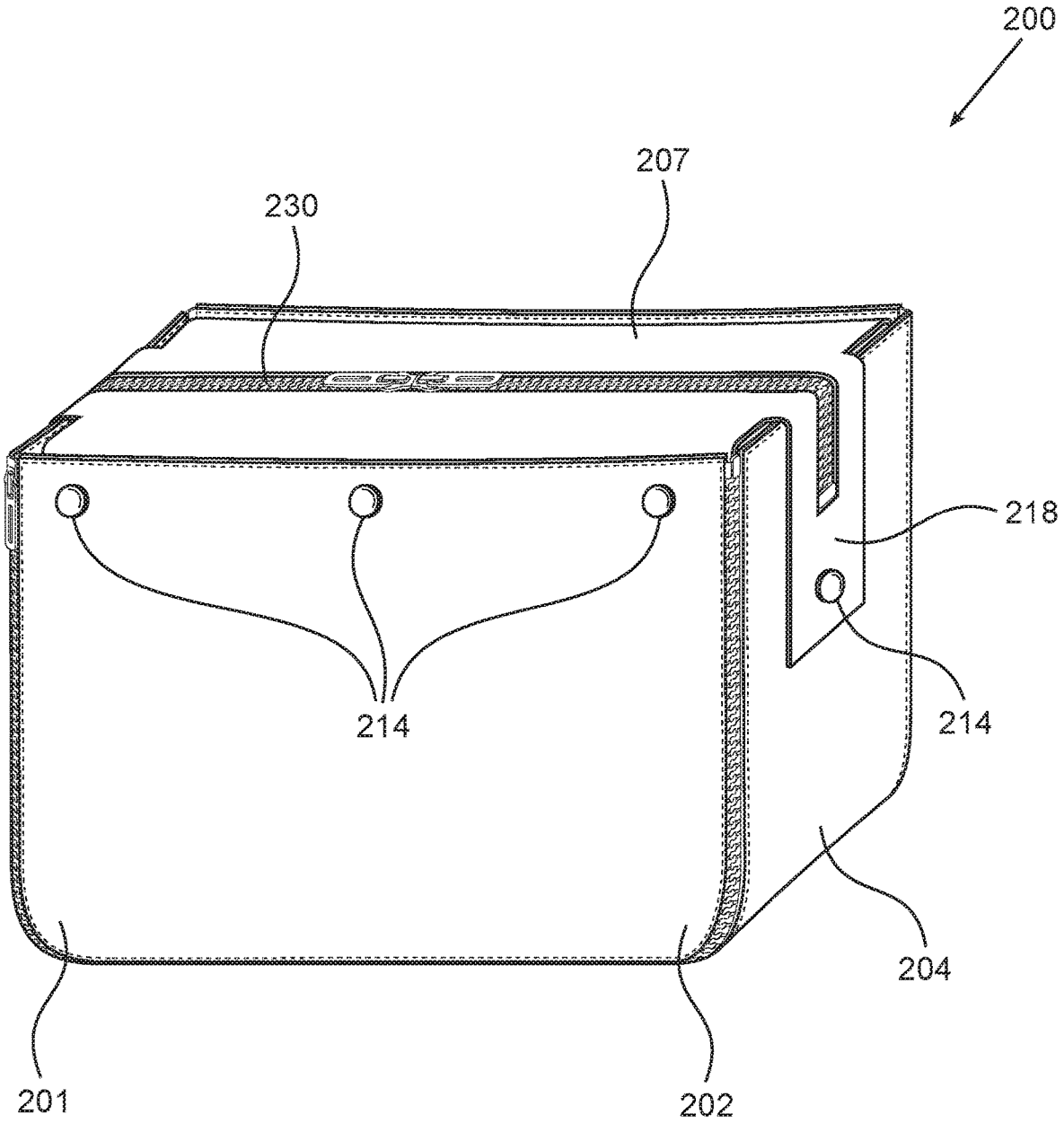
FIG. 12 is a side perspective view presentation showing the handbag of FIGS. 10-11 with an exemplary top facet having a closure/opening mechanism in the form of a midline zipper, according to some embodiments of the invention.

A fourth detachable/replaceable part may be further added, i.e., a top facet. Various alternatives may be applicable as a top facet, for covering an opening of bag body 201. As illustrated in FIG. 12, handbag 200 may include an optional top facet 207 having a midline closure mechanism in the form of zipper 230 for allowing opening and closing the bag. Top facet 207 is detachable and/or replaceable. An engagement mechanism in the form of snaps is disposed on longitudinal opposing ends of top facet 207 and are used to connect it to front facet 202 and back facet via snaps 214. The attachment of top facet 207 to side facets 204 and 205 may be configured via foldable side extensions 218 which flap over the top end of side facets 204 and 205.

Figure 13:
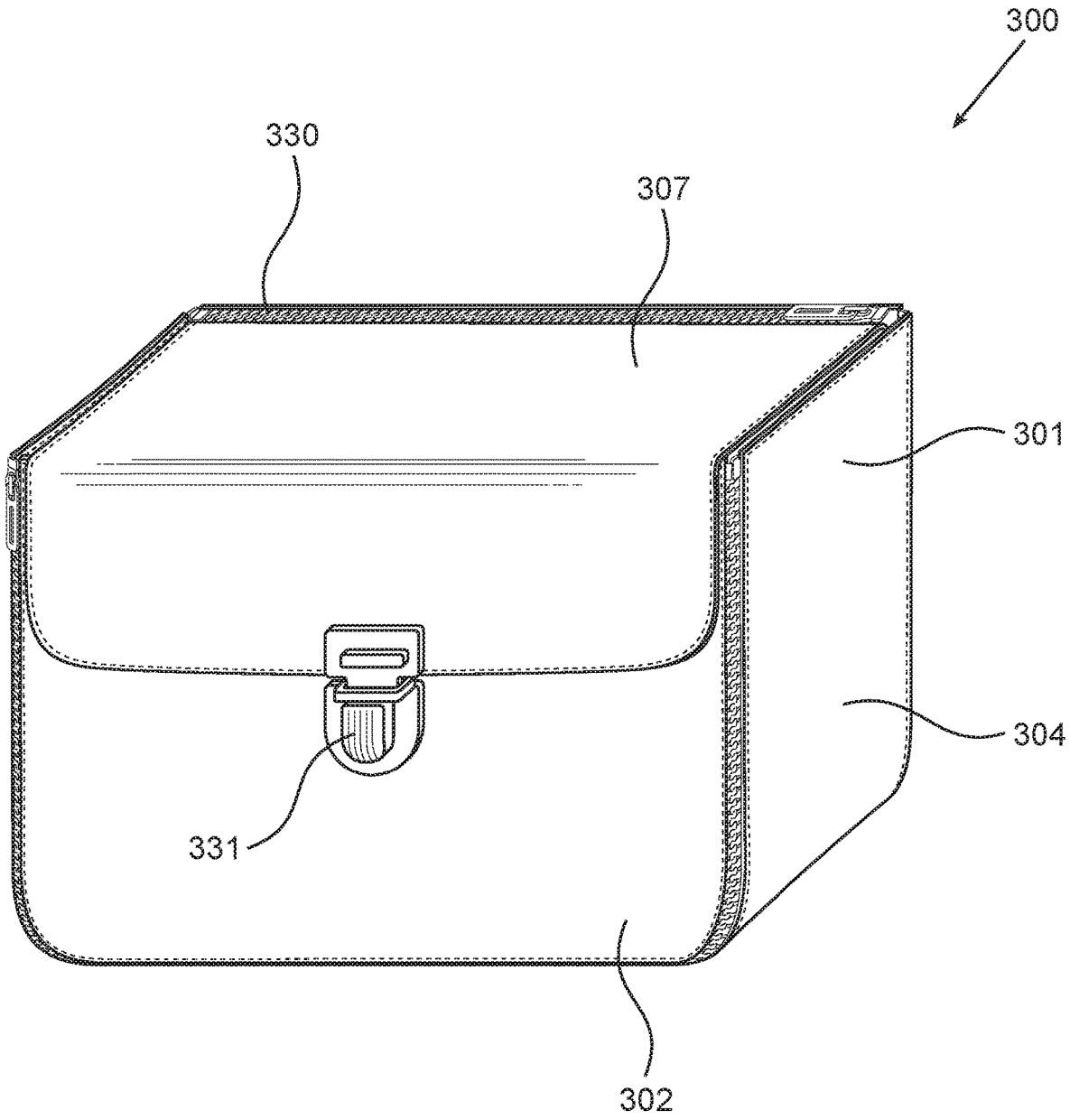
FIG. 13 is a side perspective view presentation showing an exemplary handbag with a top facet having a closure/opening mechanism in the form of a push clasp, according to some embodiments of the invention.

FIG. 13 illustrates yet another exemplary handbag 300 which is similar to handbag 200 but includes a top facet 307 which flaps over the front facet 302 and includes a push clasp 330 as a closure/opening mechanism. A zipper 330 is disposed along a top end of back facet and a longitudinal end of top facet 307 and is used as an engagement mechanism to connect top facet 307 to bag body 301. It is to be noted that zipper 330 may be applicable as a closure/opening mechanism of bag 300.

Figure 14:
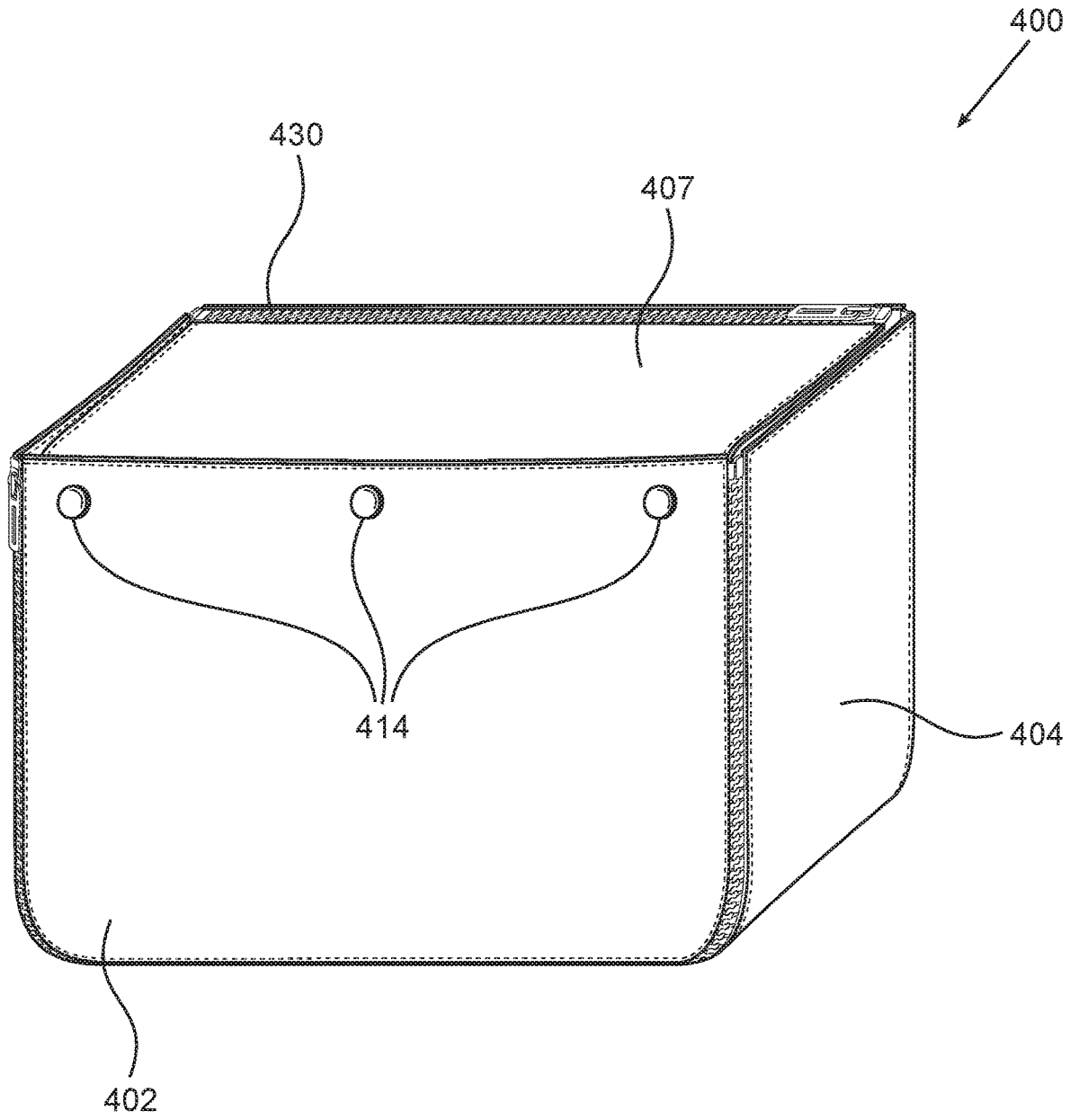
FIG. 14 is a side perspective view presentation showing an exemplary handbag with a top facet having a closure/opening mechanism in the form of snaps and a zipper, according to some embodiments of the invention.

FIG. 14 illustrates yet another exemplary handbag 400 with a top facet 407 which flaps internally, overlapping the top end of front facet 402. The bag's closure/opening or engagement mechanism in this case includes female snaps 414 which can cooperate with male snaps (not shown) disposed along a longitudinal end of top facet 407. A zipper 430 is disposed along a top end of back facet and a longitudinal end of top facet 407 and is used as the bag's closure/opening or engagement mechanism.

Each of the following terms: 'includes', 'including', 'has', 'having', 'comprises', and 'comprising', and, their linguistic, as used herein, means 'including, but not limited to', and is to be taken as specifying the stated component(s), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase 'consisting essentially of'.

Each of the phrases 'consisting of' and 'consists of', as used herein, means 'including and limited to'.

The term 'method', as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Throughout this disclosure, a numerical value of a parameter, feature, characteristic, object, or dimension, may be stated or described in terms of a numerical range format. Such a numerical range format, as used herein, illustrates implementation of some exemplary embodiments of the invention, and does not inflexibly limit the scope of the exemplary embodiments of the invention. Accordingly, a stated or described numerical range also refers to, and encompasses, all possible sub-ranges and individual numerical values (where a numerical value may be expressed as a whole, integral, or fractional number) within that stated or described numerical range. For example, a stated or described numerical range 'from 1 to 6' also refers to, and encompasses, all possible sub-ranges, such as 'from 1 to 3', 'from 1 to 4', 'from 1 to 5', 'from 2 to 4', 'from 2 to 6', 'from 3 to 6', etc., and individual numerical values, such as '1', '1.3', '2', '2.8', '3', '3.5', '4', '4.6', '5', '5.2', and '6', within the stated or described numerical range of 'from 1 to 6'. This applies regardless of the numerical breadth, extent, or size, of the stated or described numerical range.

Moreover, for stating or describing a numerical range, the phrase 'in a range of between about a first numerical value and about a second numerical value', is considered equivalent to, and meaning the same as, the phrase 'in a range of from about a first numerical value to about a second numerical value', and, thus, the two equivalently meaning phrases may be used interchangeably.

The term 'about', is some embodiments, refers to ±30% of the stated numerical value. In further embodiments, the term refers to ±20% of the stated numerical value. In yet further embodiments, the term refers to ±10% of the stated numerical value.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub combination in the context or format of a single embodiment, may also be illustratively described and presented in the context or format of a plurality of separate embodiments.

Although the invention has been described in conjunction with specific embodiments thereof, it is evident that many alternatives, modifications, and variations will be apparent to those skilled in the art. Accordingly, it is intended to embrace all such alternatives, modifications, and variations that fall within the spirit and broad scope of the appended claims.

All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

The invention claimed is:

1. A modular and changeable handbag, the handbag comprising:

a front facet, a back facet, a first and second side facets, and a bottom facet, wherein the facets, when joined together, form a bag's body, wherein at least one of the facets is reversibly detachable from the bag's body, allowing attachment and detachment or replacement thereof with an alternative facet, wherein the bottom facet includes foldable side flaps configured to overlap bottom ends of the side facets and attach thereto, and wherein the flaps connected to the bottom ends of the side facets via an engagement mechanism comprising a magnetizing element and a magnetized element.

2. The handbag of claim 1, wherein the front and back facets of the bag's body are reversibly detachable and interchangeable.

3. The handbag of claim 1, wherein the side facets of the bag's body are reversibly detachable and interchangeable.

4. The handbag of claim 1, wherein the bottom facet of the bag's body is reversibly detachable and interchangeable.

5. The handbag of claim 1, wherein the front facet, back facet, and first and second side facets, are reversibly detachable and interchangeable.

6. The handbag of claim 1, wherein the front facet, back facet, first and second side facets, and bottom facet are reversibly detachable and interchangeable.

7. The handbag of claim 1, wherein the one or more reversibly detachable facets is connected to adjacent facets via a reversible engagement mechanism.

8. The handbag of claim 7, wherein the reversible engagement mechanism selected from the group consisting of: a zipper, a snap, a button, a velcrohook and lock mechanism, an adhesive, a magnet, a clasp, clips, custom made attachment, custom closure, key, lock, buckle, knot, bow, twist lock, turn lock, tuck lock, and combinations thereof.

9. The handbag of claim 1, further comprising one or more straps configured to connect the bag's body via attachment means disposed on one or more of the facets and corresponding attachment means disposed on the straps' ends.

10. The handbag of claim 9, wherein the straps selected from handle straps, shoulder straps and long cross-body straps.

11. The handbag of claim 9, wherein the straps attachment means selected from a clip, a buckle, a snap, an adhesive, a magnet, a snap hook-ring.

12. The handbag of claim 1, for allowing customized redesign of the handbag by replacement of one or more of the facets with one or more alternative facets having a different color, fabric or drawing.

13. A modular and changeable handbag, the handbag comprising:

a front facet, a back facet, a first and second side facets, a bottom facet, and a top facet for covering a top opening of the bag's body, wherein the facets, when joined together, form a bag's body, wherein at least one of the facets is reversibly detachable from the bag's body, allowing attachment and detachment or replacement thereof with an alternative facet, wherein the top facet is reversibly detachable from one or more facets of the bag's body, wherein the top facet includes an opening/closure mechanism for allowing opening and closing the bag's body wherein the bottom facet includes foldable side flaps configured to overlap bottom ends of the side facets and attach thereto, and wherein the flaps connected to the bottom ends of the side facets via an engagement mechanism comprising a magnetizing element and a magnetized element.

14. The handbag of claim 13, wherein the top facet is connected to one or more of the bag's body facets via a reversible engagement mechanism.

15. The handbag of claim 14, wherein the reversible engagement mechanism is selected from the group consisting of: a zipper, a snap, a button, a hook and lock mechanism, an adhesive, a magnet, a clasp, clips, custom made attachment, custom closure, and combinations thereof.

16. The handbag of claim 13, wherein the opening/closure mechanism is selected from a group consisting of a zipper, a snap, a button, a hook and lock mechanism, an adhesive, a magnet, a clasp, clips, custom made attachment, custom closure, key, lock, buckle, knot, bow, twist lock, turn lock, tuck lock, and combinations thereof.

* * * * *